US010603785B1

(12) United States Patent
Hsieh

(10) Patent No.: US 10,603,785 B1
(45) Date of Patent: Mar. 31, 2020

(54) TOOL RACK

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 0 days.

(21) Appl. No.: 16/414,189

(22) Filed: May 16, 2019

(51) Int. Cl.
*B25H 3/04* (2006.01)
*B25H 3/00* (2006.01)

(52) U.S. Cl.
CPC ..... *B25H 3/04* (2013.01); *B25H 3/003* (2013.01)

(58) Field of Classification Search
CPC ..... B25H 3/04; B25H 3/006
USPC ..... 211/70.6
See application file for complete search history.

(56) References Cited

U.S. PATENT DOCUMENTS 2,371,433 A * 3/1945 Davis ..... B25H 3/04 211/70.6
4,159,773 A * 7/1979 Losenno ..... A47G 29/08 211/70.6
4,781,608 A * 11/1988 Hillmann ..... B60M 1/307 211/94.01
5,165,629 A * 11/1992 Breveglieri ..... A47F 5/0884 211/60.1
5,228,570 A * 7/1993 Robinson ..... B25H 3/06 206/375
5,715,951 A * 2/1998 Dembicks ..... B25B 13/56 206/378
6,070,745 A * 6/2000 Dembicks ..... B25H 3/06 206/378
6,168,018 B1 * 1/2001 Ramsey ..... B25H 3/06 206/378
6,450,338 B1 * 9/2002 Chen ..... B25H 3/003 206/378
6,488,151 B2 * 12/2002 Ramsey ..... B25H 3/06 206/378
7,108,132 B2 * 9/2006 Shih ..... B25B 13/56 206/378
7,152,747 B2 * 12/2006 Wang ..... A47F 5/0006 211/70.6
7,717,278 B2 * 5/2010 Kao ..... B25H 3/04 206/349
7,882,965 B1 * 2/2011 Kao ..... B25H 3/04 211/106.01
8,096,516 B2 * 1/2012 Shiao ..... B25H 3/04 211/70.6
8,302,786 B2 * 11/2012 Kao ..... A47F 5/0846 211/70.6
8,403,155 B1 * 3/2013 Kao ..... B25H 3/04 206/376

(Continued)

FOREIGN PATENT DOCUMENTS

FR 2846950 A1 * 5/2004 ..... B25H 3/04
FR 3018713 B1 * 4/2016 ..... B25H 3/003

*Primary Examiner* — Stanton L Krycinski
(74) *Attorney, Agent, or Firm* — Egbert Law Offices, PLLC

(57) ABSTRACT

A tool rack has a long base and a positioning structure disposed in the base, wherein the positioning structure includes a plugged impression, a socket seat and a connecting part, wherein the plugged impression is provided with a convex column for positioning the socket. The socket seat is used for positioning the socket wrench. The positioning structure can be used to dispose the socket and the socket wrench which are often used together, and it can improve the convenience of the tool user to take and store the socket and the socket wrench.

17 Claims, 9 Drawing Sheets

(56) References Cited

U.S. PATENT DOCUMENTS

| | | | | |
|---|---|---|---|---|
| 8,479,929 | B1 * | 7/2013 | Kao | B25H 3/04 211/69 |
| 8,733,561 | B2 * | 5/2014 | Kao | B25H 3/04 206/378 |
| 8,733,562 | B2 * | 5/2014 | Kao | B25H 3/04 206/378 |
| 9,144,306 | B2 * | 9/2015 | Kao | A47B 81/00 |
| 9,205,552 | B2 * | 12/2015 | Kao | F16M 13/022 |
| 9,375,836 | B2 * | 6/2016 | Su | B25H 3/04 |
| 9,527,206 | B1 * | 12/2016 | Hsieh | B25H 3/003 |
| 9,538,862 | B2 * | 1/2017 | Kao | A47F 5/08 |
| 9,539,721 | B1 * | 1/2017 | Kao | B25H 3/003 |
| 2005/0102793 | A1 * | 5/2005 | Shih | B25H 3/003 16/96 R |
| 2006/0219647 | A1 * | 10/2006 | Shih | B25H 3/003 211/70.6 |
| 2007/0017886 | A1 * | 1/2007 | Kao | A47F 5/0807 211/94.01 |
| 2010/0072341 | A1 * | 3/2010 | Kao | B25H 3/04 248/340 |
| 2011/0180500 | A1 * | 7/2011 | Kao | B25H 3/04 211/70.6 |
| 2012/0248051 | A1 * | 10/2012 | Kao | B25H 3/04 211/70.6 |
| 2016/0016306 | A1 * | 1/2016 | Haddon | B25H 3/04 211/70.6 |

* cited by examiner

TOOL RACK

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a positioning device for the tools, and more particularly to a tool rack with an innovative structure.

2. Description of Related Art Including Information Disclosed Under 37 CFR 1.97 and 37 CFR 1.98

A conventional tool rack for disposing sockets comprises a long slide rail and a plurality of socket seats disposed on the slide rail, each socket seat can slide along the slide rail, each socket seat respectively has a convex column, the slide rail can be arranged on a vertical face or a plane, when the socket is disposed by each socket seat, this socket is sleeved on the convex column.

The socket and socket wrench are the hand tools to be often used together, although said conventional tool rack can be used to dispose the socket, it cannot be used to dispose the socket wrench, so that the socket and socket wrench must be disposed respectively by using the different storage devices, which causes the inconvenience to the tool user in taking and storing the tools.

BRIEF SUMMARY OF THE INVENTION

The main object of the present invention is to provide a tool rack, which aims to solve the technical problems, and develop a more practical new type for disposing the socket and the socket wrench, in order to improve the convenience of tool use and storage.

For said purpose, the technical characteristics of the present invention for solving the problem in the tool rack mainly include:

- a long base, the base has a sliding chute at the top edge concave, the sliding chute is extended at both ends of the base; and
- a positioning structure is disposed in the base, so that the positioning structure is slid back and forth along the sliding chute; the positioning structure comprises: a plugged impression, a socket seat and a connecting part, wherein the plugged impression is connected with the socket seat by the connecting part. The plugged impression is embedded in the sliding chute, and the plugged impression has a convex column on the top edge convex. The center line of the convex column passes through the two ends of the convex column, and one end of the center line extends through the sliding chute, and the convex column is provided with a positioning part at one side, so that the convex column can position a socket;

The socket seat is laterally opposite to the base, and the top edge of the socket seat is recessed with a socket hole, in which at least one positioning hole is disposed in the hole wall of the socket hole, so that the socket seat can position the driving part of a socket wrench.

Another object of the present invention is to achieve the advantages of high stability and practical progress by means of the relative composition of the base and the positioning structure.

Based on another purpose, the technical characteristics of the present invention for solving the problem is mainly the tool rack as described above, wherein the bottom edge of the base and the bottom edge of the socket seat are in a highly flush correspondence, so that the stability of the tool rack is improved.

The main effects and advantages of the present invention are the ability to dispose the frequently-used socket and socket wrenches, to improve the accessibility and storage convenience of the tool.

DETAILED DESCRIPTION OF THE INVENTION

Each figure shows a concrete and feasible embodiment of the tool rack of the present invention, such embodiment is for illustration only and it is not subject to such structure in patent application.

Figure 1:
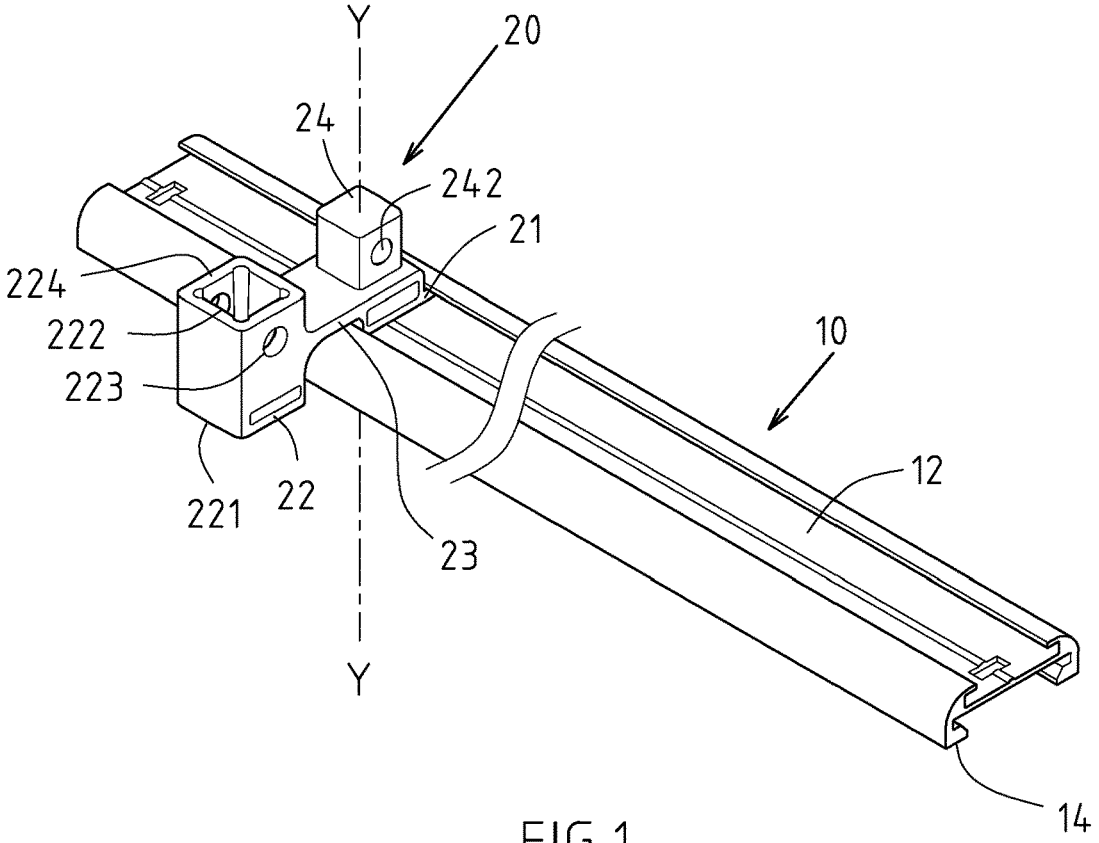
FIG. 1 is a three-dimensional diagram of Embodiment 1 of the present invention.
Figure 2:
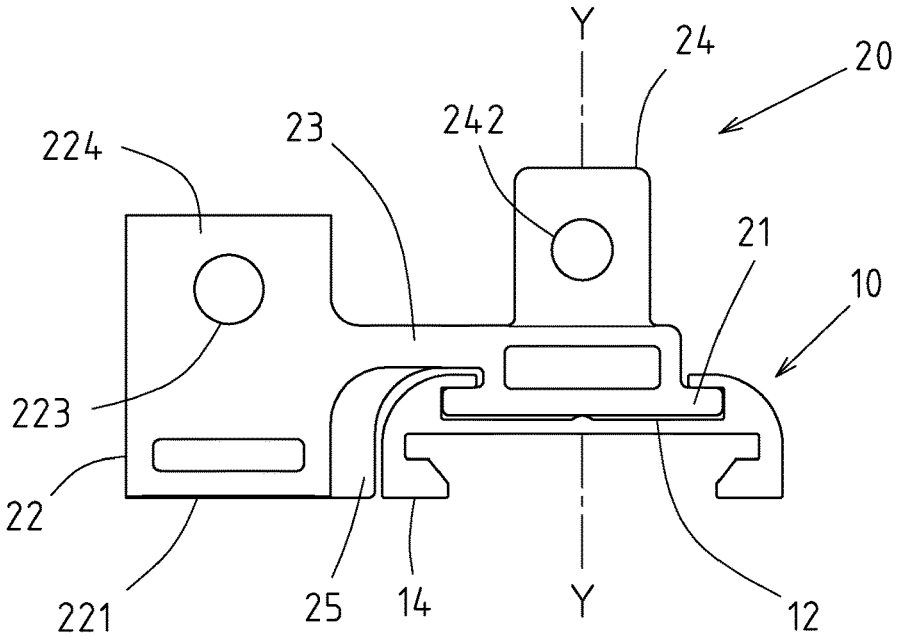
FIG. 2 is a right side view of Embodiment 1 of the present invention.

As shown in FIGS. 1 and 2, Embodiment 1 of the tool rack of the present invention includes a long base 10 and a positioning structure 20, wherein the base 10 has a sliding chute 12 at a top edge concave, and the sliding chute 12 is extended to both ends of the base 10, the positioning structure 20 is disposed in the base 10, and it can be slid back and forth along the sliding chute 12, the bottom edge 14 of the base 10 is a plane.

Figure 4:
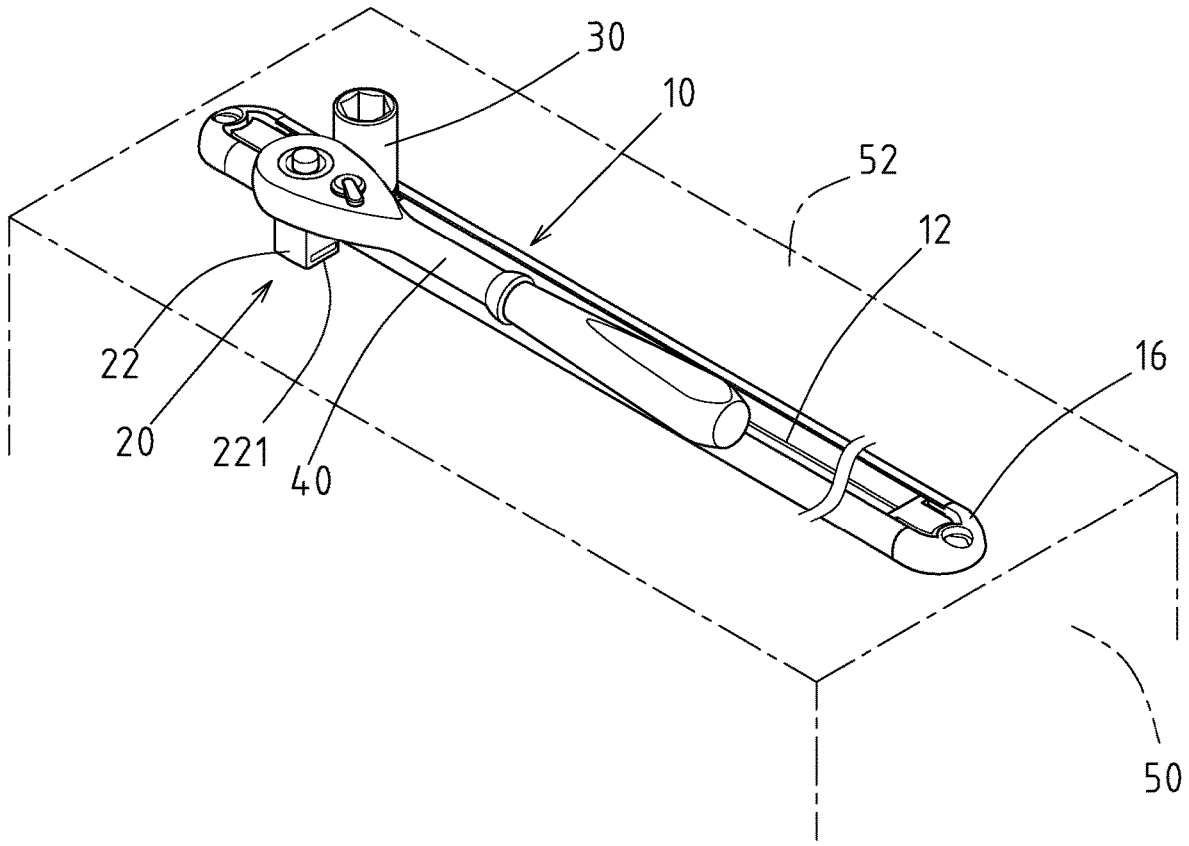
FIG. 4 is a three-dimensional schematic diagram of Embodiment 1 of the present invention, disposed with the two sealing members in a flat use state.

The positioning structure 20 includes a plugged impression 21, a socket seat 22 and a connecting part 23, wherein the plugged impression 21 is embedded in the sliding chute 12, so that the positioning structure 20 is slid back and forth along the sliding chute 12, the plugged impression 21 is connected with the socket seat 22 by the connecting part 23. The plugged impression 21 has a convex column 24 at the top edge convex, and the convex column 24 is provided with a positioning part 242 at one side, so that the convex column 24 can position a socket 30 (as shown in FIG. 4). The center line YY of the convex column 24 is defined as a central virtual line passing through both ends of the convex column 24. One end of the center line YY extends through the sliding chute 12, and the socket seat 22 is laterally opposite to the base 10, the bottom edge 14 of the base 10 and the bottom edge 221 of the socket seat 22 are in a highly flush correspondence, so that the stability of the tool rack is improved; further, the bottom edge 221 of the socket seat 22 is plane, thereby improving the stability of the tool rack.

the top edge of the socket seat 22 is recessed with the socket hole 222, and the recessed direction of the socket hole 222 is the same as the recessed direction of the sliding chute 12. The sliding chute 22 is provided with two positioning holes 223 in the hole wall 224 of the socket hole 222. The positioning holes 223 is opposite to each other on both sides of the socket hole 222, and each positioning hole 223 respectively passes through the hole wall 224 of the socket hole 222, so that the socket seat 22 can position the driving part 41 of a socket wrench 40 (shown as in FIG. 4 and FIG. 5); the number of the positioning hole 223 may be increased or decreased as needed, and is not limited to the number shown in the figure. The change in the number is simply based on the present embodiment.

Figure 3:
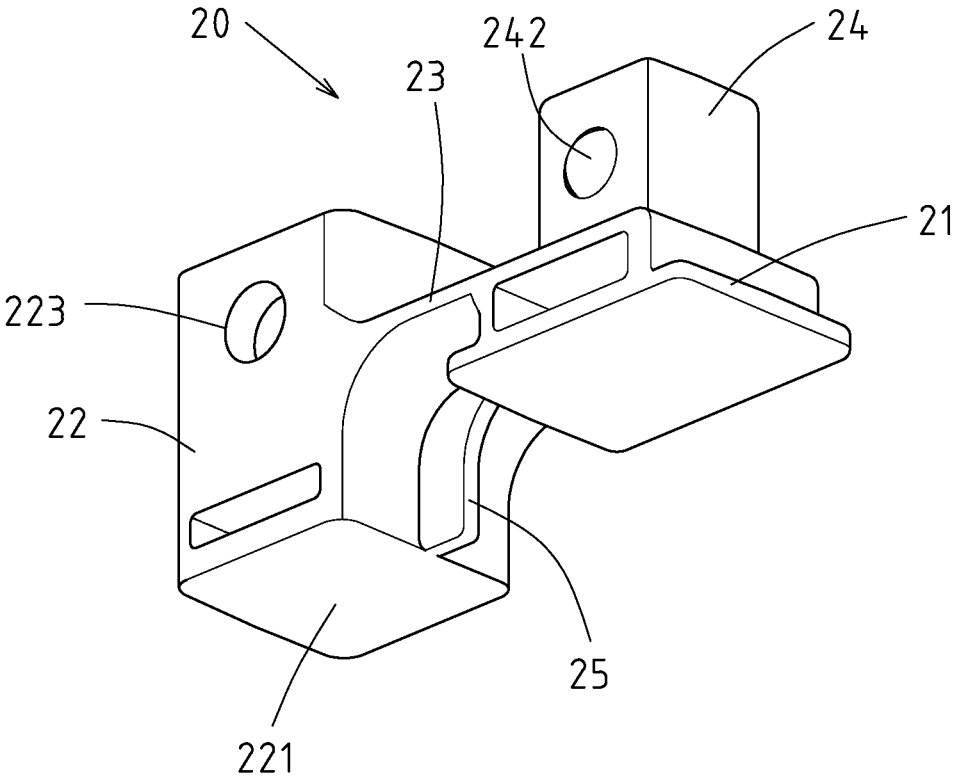
FIG. 3 is a three-dimensional diagram of the positioning structure of Embodiment 1 of the present invention at an angle of elevation.

As shown in FIGS. 2 and 3, the positioning structure 20 is provided with a rib 25 on the bottom edge of the connecting part 23 and the opposite side of the socket seat 22 adjacent to the base 10, the rib 25 forms a reinforcing effect on the connecting part 23 and the socket seat 22. When the tool is disposed in the positioning structure 20, the strength of the positioning structure 20 for supporting the tool weight is increased; further, when the positioning structure 20 positions the socket wrench of various specifications and sizes, the rib 25 can increase the length of the connecting part 23, and the lateral distance between the socket seat 22 and the base 10 can be improved, so that the socket wrench positioned between the clamping arms 24 and the socket positioned on the convex column 24 do not touch each other or even interfere with each other, and the convenience of the socket and the socket wrench in the positioning structure 20 is improved.

As shown in FIG. 4, when the socket 30 and the socket wrench 40 are positioned by using Embodiment 1, the base 10 can be respectively provided with a stopper 16 at both ends, and both ends of the sliding chute 12 are closed by the stopper 16, so that the positioning structure 20 will not be arbitrarily removed from the base 10 by one end of the sliding chute 12.

Figure 5:
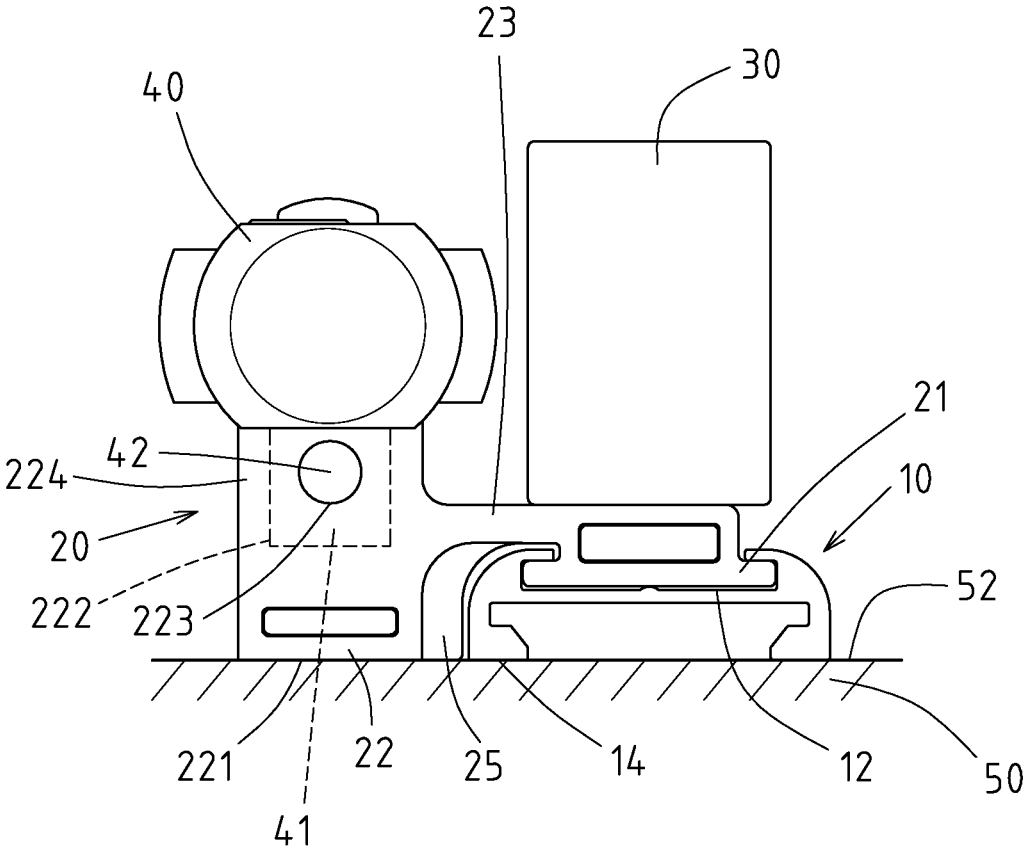
FIG. 5 is a right side view of the base and positioning structure of Embodiment 1 of the present invention in a flat use state.

FIGS. 4 and 5 show that a flat state of Embodiment 1 is disposed in a use state of surface 52 of a setting object 50, wherein the setting object 50 may be a worktable or a tool cabinet, and the base 10 is disposed on the surface 52, and the base 10 can be positioned on the surface 52 by using a screw (not shown in the figure) or a magnetic object (not shown in the figure), please refer to FIG. 1-5. The socket 30 is sleeved on the convex column 24, and the positioning part 242 is embedded in a recess (not shown in the figure) inside the socket 30 (not shown in the figure), so that the socket 30 is positioned in the convex column 24, the driving part 41 of the socket wrench 40 is inserted into the socket hole 222, and the steel ball 42 of the driving part 41 is embedded in the positioning hole 223, so that the socket wrench 40 is positioned in the socket seat 22.

Figure 6:
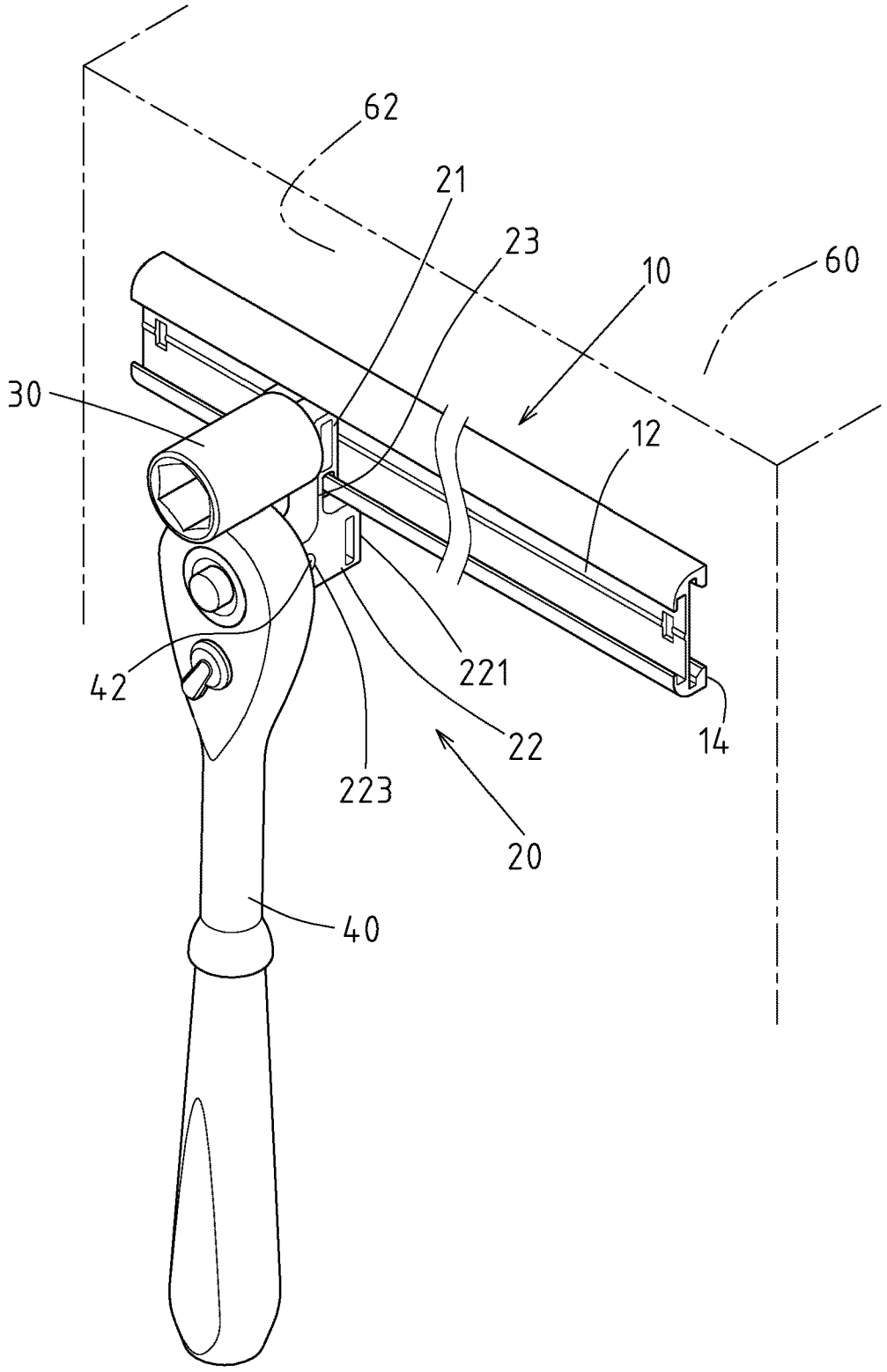
FIG. 6 is a three-dimensional schematic diagram of Embodiment 1 of the present invention in a vertical use state.
Figure 7:
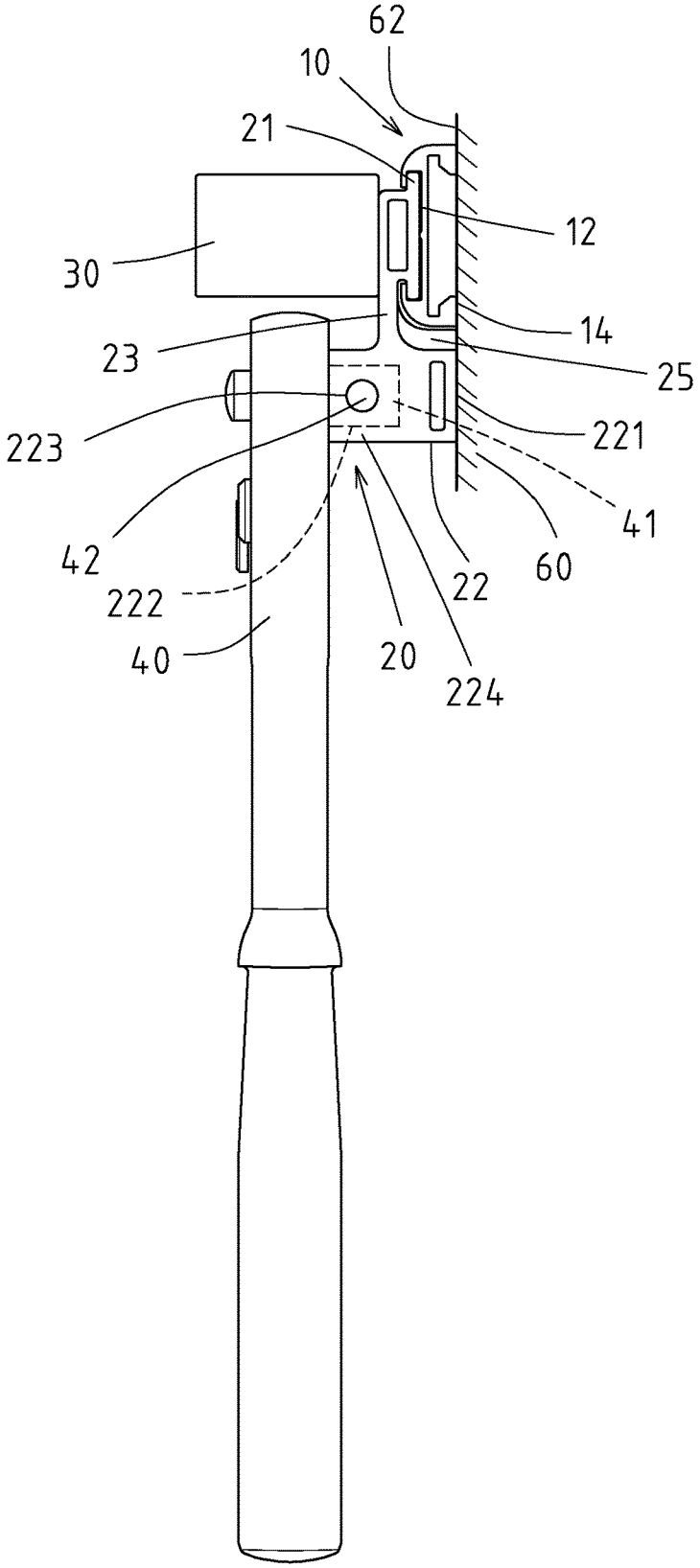
FIG. 7 is a right schematic diagram of Embodiment 1 of the present invention in a vertical use state.

FIGS. 6 and 7 show that a vertical state of Embodiment 1 is disposed in a use state of a surface 62 of a setting object 60, wherein the setting object 60 may be a wall or a tool cabinet, and the surface 62 is formed in the vertical face of the setting object 60, and the base 10 can be selectively positioned on the surface 62 by using the screw (not shown in the figure) or magnetic object (not shown in the figure); please refer to FIGS. 1 and 2 as well as FIGS. 6 and 7, the socket 30 is sleeved on the convex column 24, and the positioning part 242 is embedded in a recess (not shown in the figure) inside the socket 30, so that the socket 30 is positioned in the convex column 24, and the driving part 41 of the socket wrench 40 is disposed in the socket hole 222, and the steel ball 42 of the driving part 41 is embedded in the positioning hole 223, so that the socket wrench 40 is positioned in the socket seat 22.

The positioning structure 20 can be used to dispose the socket 30 and the socket wrench 40 which are often used together, thereby improving the convenience of the tool user in taking and storing the socket 30 and the socket wrench 40.

As shown in FIGS. 5-7, since the bottom edge 14 of the base 10 and the bottom edge 221 of the socket seat 22 are in a in a highly flush correspondence, so that the base 10 and the socket seat 22 can be abutted against the surface 52 and 62, the setting object 50 and 60 can support the base 10 and the socket seat 22, and the tool rack is disposed with high stability. When the socket wrench 40 is disposed by each socket seat 22, the weight of the socket wrench 40 acts on the socket seat 22, the setting object 50 and 60 can support the base 10 and the socket seat 22, so that the socket seat 22 and the connecting part 23 will not be deformed by the weight of the socket wrench 40.

Figure 8:
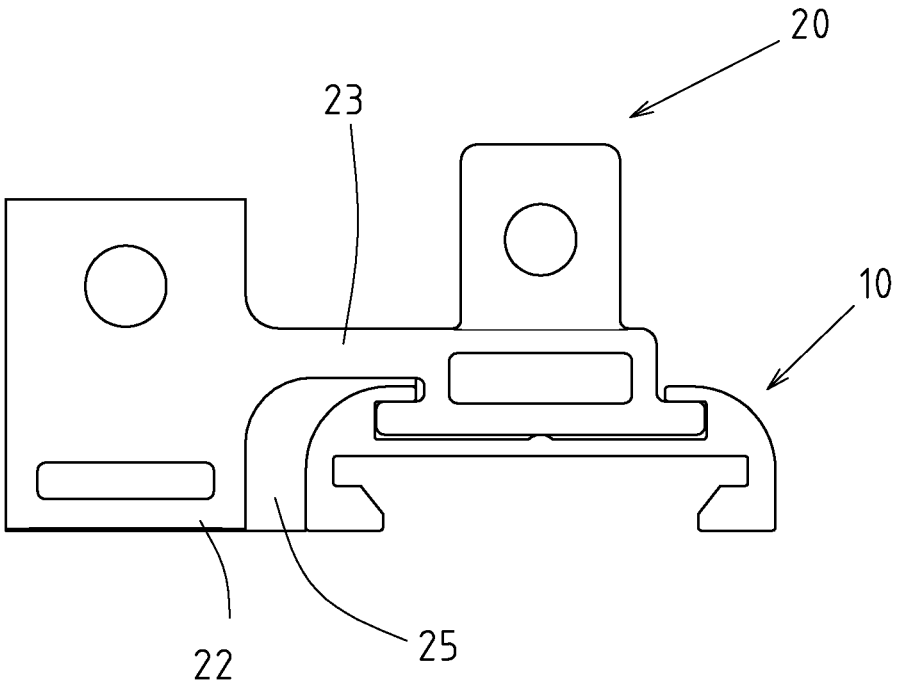
FIG. 8 is a right side view of Embodiment 2 of the present invention.

FIG. 8 shows that Embodiment 2 is obtained based on the change of Embodiment 1. Embodiment 2 includes a long base 10 and a positioning structure 20, and the same composition of Embodiment 2 and Embodiment 1 is not repeatedly described. The composition of Embodiment 2 different from Embodiment 1 is mainly that the positioning structure 20 is provided with a rib 25 on the bottom edge of the connecting part 23 and the opposite side of the socket seat 22 adjacent to the base 10, and the rib 25 is abutted against the base 10, so that the socket seat 22 and the base 10 are positioned oppositely each other. When the tool rack needs to be moved for changing the disposed place of the tool rack, the socket seat 22 will not be shaken during the movement. The rib 25 can increase the strength of the socket seat 22 and the connecting part 23. When the socket wrench 40 is disposed by the socket seat 22, the weight of the socket wrench 40 acts on the socket seat 22, and the rib 25 can avoid that the socket seat 22 and the connecting part 23 are deformed due to the weight of the socket wrench 40, and the base 10 supports the rib 25, the socket seat 22 and the connecting part 23, thereby improving the stability of the tool rack.

Figure 9:
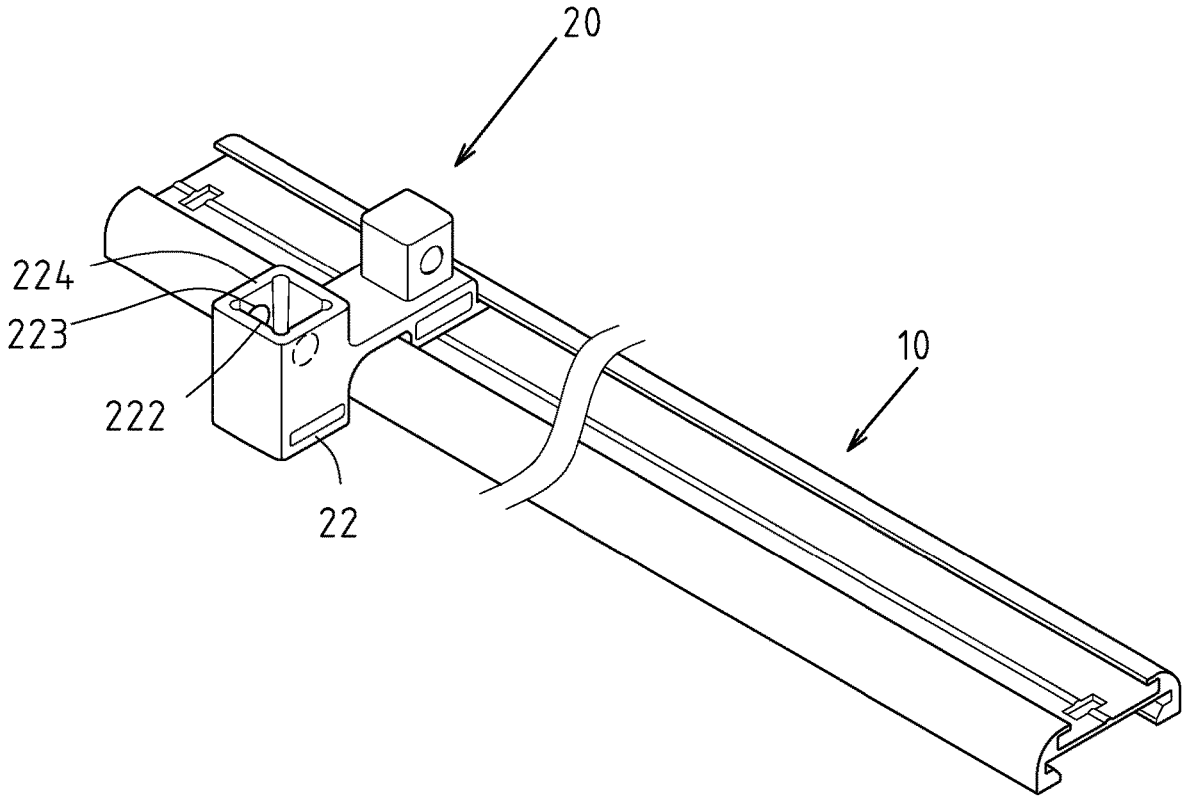
FIG. 9 is a three-dimensional diagram of Embodiment 3 of the present invention.

Embodiment 1 can be further changed to Embodiment 3, as shown in FIG. 9, and Embodiment 3 includes a long base 10 and a positioning structure 20. Embodiment 3 differs from Embodiment 1 mainly in that the socket seat 22 of the positioning structure 20 is recessed at least by a positioning hole 223 in the hole wall 224 of the socket hole 222, and the positioning hole 223 does not pass through a ball-shaped blind hole of the hole wall 224. The positioning hole 223 is used for that the steel ball 42 of the driving part 41 of a socket wrench 40 is embedded and positioned.

Figure 10:
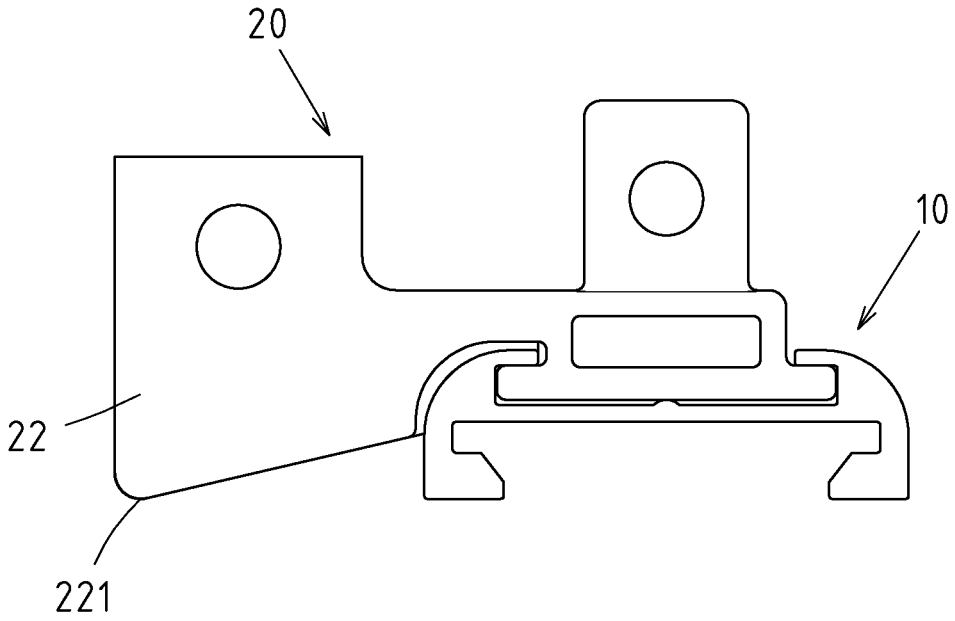
FIG. 10 is a right side view of Embodiment 4 of the present invention.

Embodiment 1 can be further changed to Embodiment 4, as shown in FIG. 10, and Embodiment 4 includes a long base 10 and a positioning structure 20. Embodiment 4 differs from Embodiment 1 mainly in that the bottom edge 221 of the socket seat 22 of the positioning structure 20 is pointed.

Figure 11:
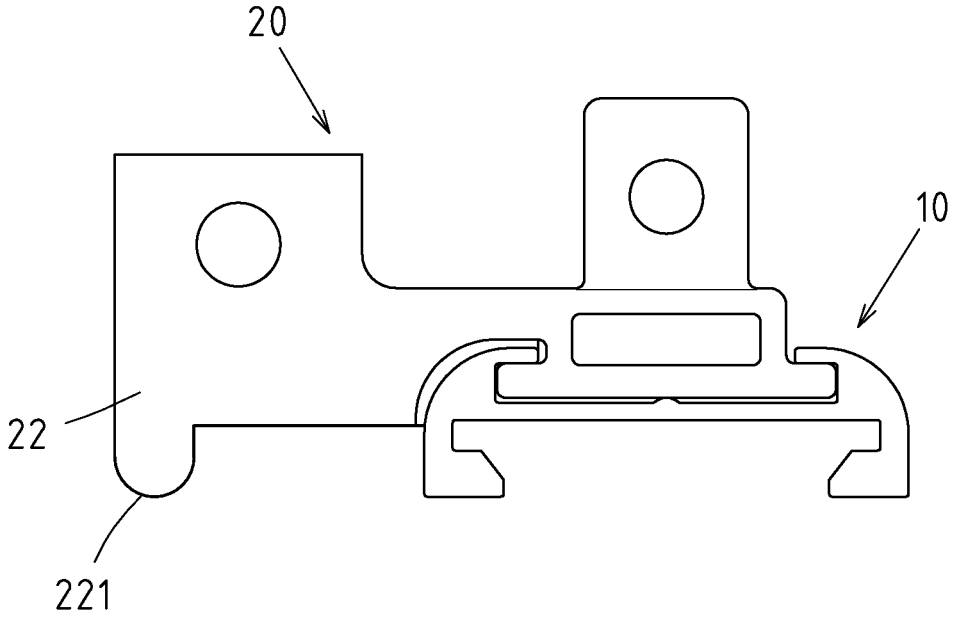
FIG. 11 is a right side view of Embodiment 5 of the present invention.

Embodiment 1 can be further changed to Embodiment 5, as shown in FIG. 11, and Embodiment 5 includes a long base 10 and a positioning structure 20. Embodiment 5 differs from Embodiment 1 mainly in that the bottom edge 221 of the socket seat 22 of the positioning structure 20 is curved.

The bottom edge 221 of the socket seat 22 of Embodiment 1 can be further changed to other non-plane shape, thereby composing other modified embodiments of the present invention, and such changes are readily thinkable on the basis of the teachings provided in Embodiment 4 and Embodiment 5.

I claim:

1. A tool rack comprising:

a base having a sliding chute at a concave top edge thereof, the sliding chute extending to opposite ends of said base; and a positioning structure disposed in said base and slidably mounted in said sliding chute, said positioning structure comprising:

a plugged impression;

a socket seat; and a connecting part connecting said plugged impression to said socket seat, said plugged impression being embedded in the sliding chute, said plugged impression having a convex column at a convex top edge thereof, wherein a center line of the convex column passes through opposite ends of the convex column, one end of the center line extending through the sliding chute, the convex column having a positioning part at one side thereof;

a socket seat positioned laterally position to said base, said socket seat having a top edge having a recessed socket hole, wherein at least one positioning hole is disposed in the socket hole, said socket seat adapted to receive a driving portion of a socket wrench.

2. The tool rack of claim 1, wherein a recessed direction of the socket hole is identical to a recessed direction of the sliding chute.

3. The tool rack of claim 1, wherein a bottom edge of said base and a bottom edge of said socket seat are flush with each other.

4. The tool rack of claim 2, wherein a bottom edge of said base and a bottom edge of said socket seat are flush with each other.

5. The tool rack of claim 3, wherein the bottom edge of said socket seat is planar.

6. The tool rack of claim 4, wherein the bottom edge of said socket seat is planar.

7. The tool rack of claim 3, wherein the bottom edge of said socket seat is non-planar.

8. The tool rack of claim 4, wherein the bottom edge of the socket seat is non-planar.

9. The tool rack of claim 3, wherein said positioning structure has a rib at a bottom edge of said connecting part and said socket seat adjacent to a side of said base.

10. The tool rack of claim 4, wherein said positioning structure has a rib at a bottom edge of said connecting part and said socket seat adjacent to a side of said base.

11. The tool rack of claim 9, wherein the rib abuts against said base.

12. The tool rack of claim 10, wherein the rib abuts against said base.

13. The tool rack of claim 1, wherein said socket seat has a pair of positioning holes on a wall of the socket hole, the pair of positioning holes being opposite to each other.

14. The tool rack of claim 1, wherein the positioning hole passes through a hole wall of the socket hole.

15. The tool rack of claim 13, wherein each of the pair of positioning holes passes through the wall of the socket hole.

16. The tool rack of claim 1, wherein the positioning hole is a ball-shaped blind hole.

17. The tool rack of claim 13, wherein each of the pair of positioning holes is a ball-shaped blind hole.

* * * * *